United States Patent [19]

Soucy

[11] 3,979,851

[45] Sept. 14, 1976

[54] ALL GAUGE SKEET SET BARREL

[75] Inventor: Kenneth W. Soucy, Richfield Springs, N.Y.

[73] Assignee: Remington Arms Company, Inc., Bridgeport, Conn.

[22] Filed: Mar. 26, 1975

[21] Appl. No.: 562,167

[52] U.S. Cl. ..... 42/77; 42/75 B; 42/76 R

[51] Int. Cl.[2] ..... F41C 21/06

[58] Field of Search ..... 42/76 R, 77, 75 B; 89/14 R

[56] References Cited

UNITED STATES PATENTS

| | | | |
|---|---|---|---|
| 1,661,949 | 3/1928 | Krenek | 42/75 B |
| 1,760.731 | 5/1930 | Williams | 42/77 |
| 2,447,091 | 8/1948 | Pope | 42/76 R |
| 3,611,611 | 10/1971 | Quinney | 42/77 |
| 3,842,527 | 10/1974 | Low | 42/76 R |

*Primary Examiner*—Charles T. Jordan

*Attorney, Agent, or Firm*—John H. Lewis, Jr.; Nicholas Skovran; William L. Ericson

[57] ABSTRACT

A gun barrel having the exterior configuration of at least a portion of its length formed in an oblong shape in which the width of the oblong portion is greater than its height. This configuration permits the interchangeability of a plurality of gun barrels in a common receiver and common fore-end without the presence of a gap between the common fore-end and the smaller outside diameters of the smaller bore barrels since the oblong portions of the smaller bore barrels have a width equal to the outside diameter of the largest bore barrel designed to be interchangeable with the common receiver and common fore-end.

16 Claims, 11 Drawing Figures

10
12
14
16
18
20

18
20
22
24
26
28
30
32
34
36
38
40
42

ALL GAUGE SKEET SET BARREL

The present invention relates to the interchangeability of a plurality of gun barrels having different bore diameters in a common firearm receiver and a common fore-end. More particularly, the invention relates to how to fit a common fore-end to each of a number of barrels having smaller outside diameters so that there are no gaps between the barrel and the fore-end.

It is possible today to buy "Skeet Sets" or other sets of shotgun barrels of different gauges which can be interchangeably mounted on a common stock, common receiver, common fore-end, etc. Thus, a shooter can, by interchanging barrels on his basic shotgun, use the same shotgun to shoot in 12 gauge, 20 gauge, 28 gauge and 410 gauge events or to hunt with the specific gauge shotgun he wishes while retaining the basic firearm.

There are a number of advantages to this, one being the economy of using one basic firearm with four barrel assemblies, thus avoiding the necessity of purchasing four complete firearms. Another advantage is that a gun can be properly fitted to the individual shooter's wishes wherein he acquires a "feel" for a gun so that he is comfortable in shooting the specific fun. By merely changing barrels, this familiarity or "feel" for a gun need not be lost as it would be by changing guns when the shooter wishes to shoot 20, 28, or 410 gauge after shooting a 12 gauge gun. The barrel assembly is changed, and if the new barrel is properly designed and its weight distributed properly, the shooter finds the new combination has the old comfortable "feel" to him. However, as mentioned above, the idea of providing barrels of different gauges or bore diameters on a basic firearm structure is not novel to applicant.

What is novel to applicant is the means by which a series of barrels of different gauges can be utilized with a common receiver and common fore-end without introducing a gap between the fore-end and the smaller bore barrels. For the purpose of this application, we will refer to an over-and-under shotgun incorporating barrel assemblies of 12, 20, 28, and 410 gauge. Obviously, however, the concept can be use for other than this type of firearm and for other gun bore diameters.

The prior practice has included a number of different solutions to the problem presented by the gap caused by utilizing a smaller gauge barrel, e.g. a 410 gauge, in a fore-end large enough to accomodate a 12 gauge barrel.

The first solution which comes to mind is to provide a different fore-end assembly for each gauge. Thus, for a set of four barrels as described above, it would be necessary to have a separate fore-end with each of the four gauges. This obviously is expensive and naturally would add weight to and would require additional storage space for the complet set of barrel assemblies which usually is sold and transported in a special case.

Another method is to attach spacers to the small gauge barrel assemblies. These spacers fill in the gap left between the fore-end and the smaller barrel.

Still another method is to use the same fore-end for all gauges and leave the gap showing.

As mentioned, the disadvantages of the first two methods is that extra parts are required and, therefore, manufacturing costs are increased. The second method, i.e. of using spacers, requires the use of spacers which have a 12 gauge barrel contour on the outside surface and a small gauge contour on the inside surface. In addition, the spacers must be positioned and secured accurately to maintain a quality appearance. The disadvantage of the third method is the unsightly appearance of the gap when small gauge barrel assemblies are used.

It is an object of the present invention to provide a design for an all gauge firearm set using a single fore-end and no spacers.

Another object is to provide a barrel or portion thereof whose exterior surface is specially contoured so that the barrel fits a fore-end designed to accommodate a larger gauge barrel without leaving a gap between the fore-end and the smaller gauge barrel.

It is still another object of this invention to provide a method wherein a set of different gauge barrels can be utilized with a common firearm receiver and a common fore-end without leaving a gap between the common fore-end and the smaller gauge barrels.

Other objects and advantages will become apparent from the following description taken in conjunction with the accompanying drawings in which.

The proper design of an over-and-under shotgun incorporating barrel assemblies of all four gauges, i.e. 12, 20, 28, and 410, dictates that the weight and center of gravity of the different barrel assemblies be the same. Since the inside diameters, i.e. the bore, of the four gauges are different, the outside diameters must also be different in order to equalize the weights. The problem, then, is how to fit the common fore-end to the various barrel assemblies so that there are no gaps between the barrel and the adjacent common fore-end when barrels with smaller outside diameters are used.

In order that the top barrel of smaller gauge barrel assemblies, e.g. 410 gauge, fit the standard, e.g. 12 gauge size fore-end, it is only necessary that the width of the barrel be of standard or 12 gauge outside dimensions. The height of the barrel may then be reduced to the limit dictated by barrel strength requirements. The result is a barrel of oblongal cross section. The cross section is obviously noncircular but since octagonal barrels are also non-circular and have been in use for many years another team is believed necessary to design the class of contours which define the invention. Thus, the term "oblong" will be used to describe generally a barrel whose width is greater that its height. This "oblong" cross section need only be used in the area where it must fit the fore-end. In the present embodiment where an over-and-under shotgun is disclosed, the "oblong" cross section need only be used on the top barrel since there is no problem of fitting the bottom barrel to the fore-end.

Figure 1:
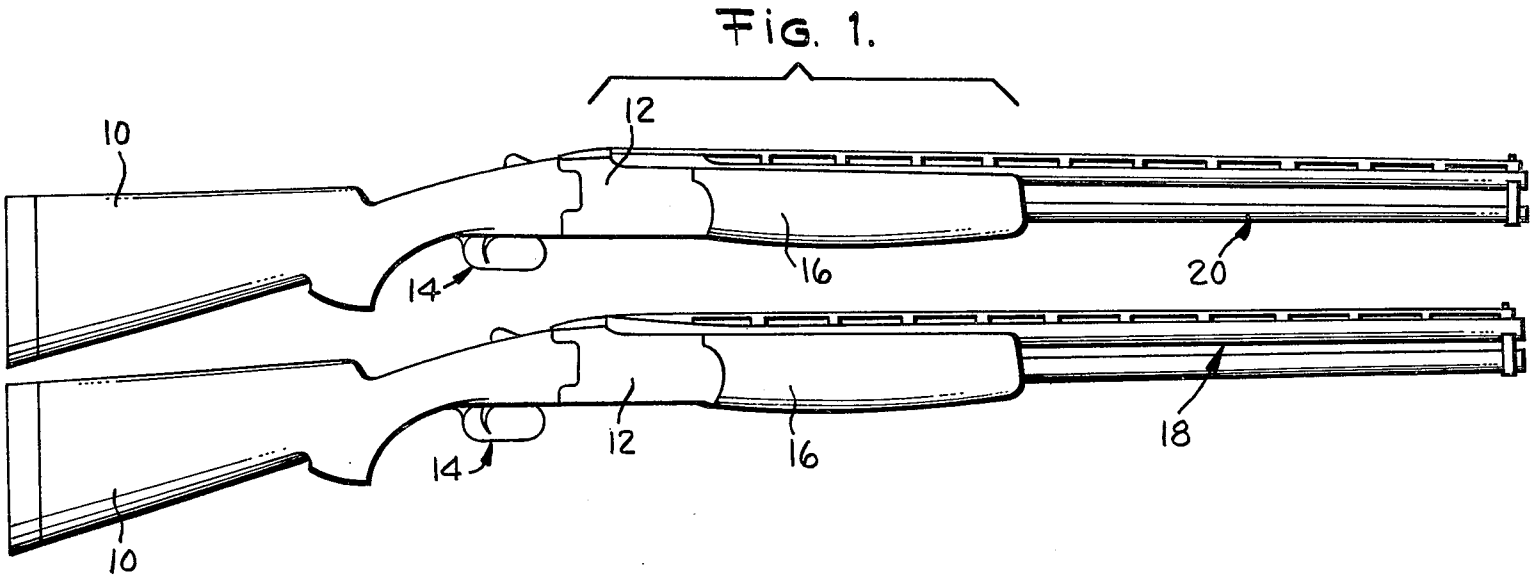
FIG. 1 is a side view of two over-and-under shotguns, the top gun having 410 gauge barrels and the lower gun having the larger 12 gauge barrels.

Referring now to the drawings, FIG. 1 shows a pair of superposed or over-and-under shotguns in which the barrels are positioned in line with and directly above one another. Except for the barrel assemblies, which are interchangeable, each of the shotguns has a stock 10, a receiver or frame 12, a trigger assembly 14 connected to a firing mechanism (not shown) and a fore-end 16. The parts listed above are common to each gun, i.e. dimensionally alike, the only difference in the guns being the interchangeable barrel assemblies. The lower gun in FIG. 1 shows a 12 gauge barrel assembly 18, which for the purposes of this application will be considered as the "standard" or largest bore diameter barrel to be used in the set of barrels designed to be used with common fore-end 16. Obviously, the concept permits other gauges, e.g. 10 gauge, to be the "standard". However, since the 12 gauge shotgun is by far the most popular in use today, we will refer to the 12 gauge barrel as the "standard".

Figure 2:
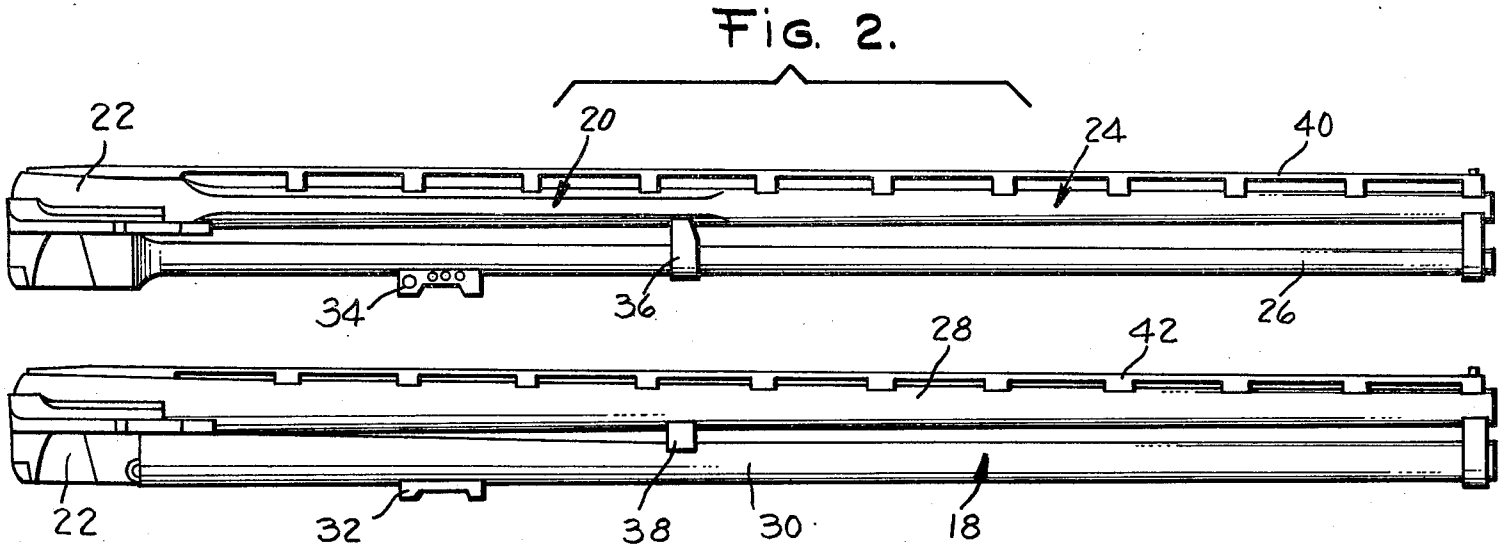
FIG. 2 is a cross-section, elevational view of two over-and-under shotgun barrel assemblies of the type shown in FIG. 1, the top assembly being of 410 gauge and the lower assembly being of the larger 12 gauge assembly.

The upper gun in FIG. 1 shows a smaller bore barrel assembly 20, e.g. the 410 gauge, as modified according to the invention. However, the modifications to the barrel assembly 20 in accordance with the present invention are not ascertainable in FIG. 1. The barrel assemblies 18 and 20 are shown separated from the common receiver 12 and fore-end 16 in FIG. 2. Barrel assemblies 18 and 20 have "common" barrel extensions which are connected to barrels 28 and 30 of barrel assembly 18 and to barrels 24 and 26 of barrel assembly 20. The barrel extensions 22 are also "common" in that they are made dimensionally alike — subject of course to manufacturing tolerances. Some of the differences in the barrel assemblies 18 and 20, as can be seen in FIG. 2, are in the fore-end support 32, and 34, the barrel connector means 36 and 38, and the vent ribs 40 and 42.

Figure 3:
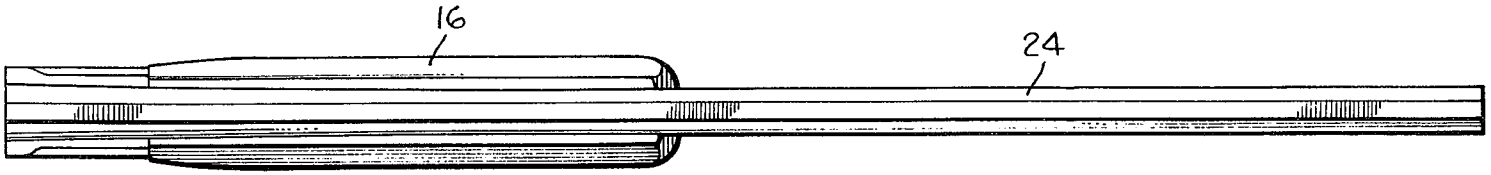
FIG. 3 is a top view of a 12 gauge barrel positioned in a "standard" or "common" 12 gauge fore-end.
Figure 4:
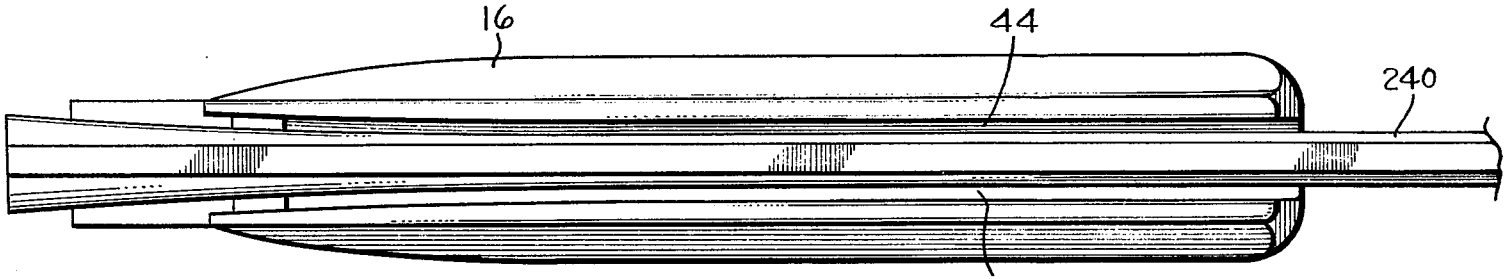
FIG. 4 is a top view of a conventional 410 gauge barrel positioned in a "standard" 12 gauge fore-end.

FIG. 3 shows a top view of a 12 gauge barrel 24 in close fitting relationship with fore-end 16. FIG. 4 shows a regular or conventional 410 gauge barrel 240 positioned in a standard 12 gauge fore-end 16. It can be seen that the outside diameter of the barrel 240 is substantially less than the distance between the open ends of the fore-end so that a gap 44 exists on both sides of the barrel between the barrel and the fore-end. It is this gap which the present invention is designed to eliminate.

Figure 5:
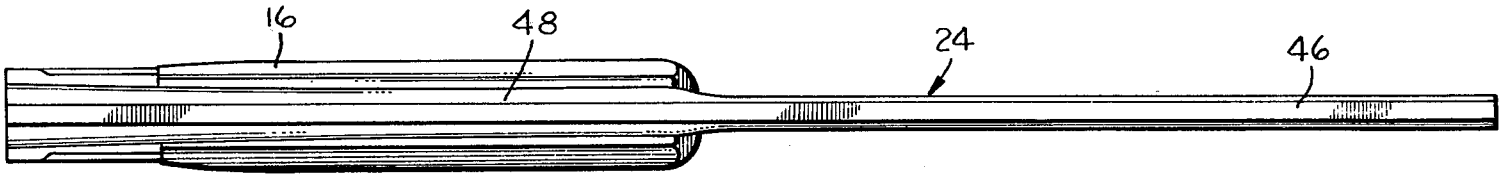
FIG. 5 is a top view of a 410 gauge barrel modified in accordance with the present invention positioned in a "standard" 12 gauge fore-end.

FIG. 5 shows a plan view of a 410 gauge barrel 24, modified in accordance with the present invention to provide a cylindrical forward portion 46 and a rear oblong section 48 which has a width equal to the corresponding section of a 12 gauge barrel 28 so that it is positioned in close fitting relationship with a standard 12 gauge fore-end 16.

Figure 6:
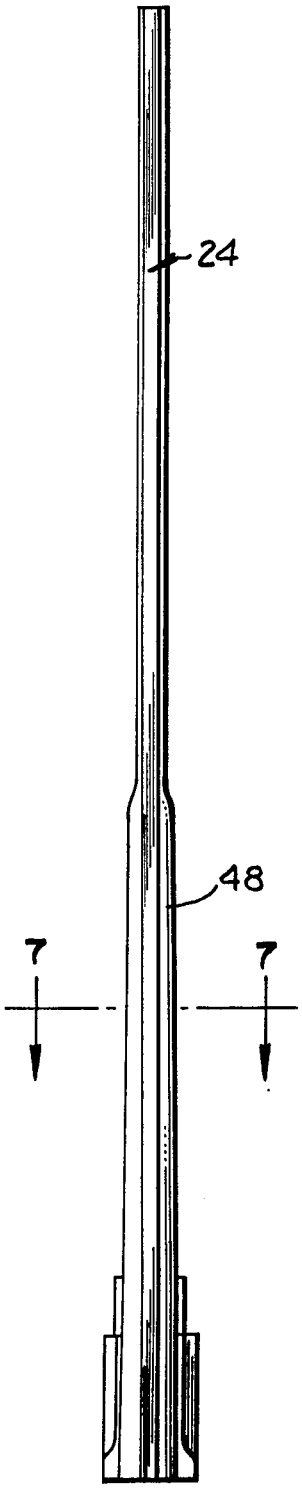
FIG. 6 is a top view of a 410 gauge barrel assembly modified in accordance with the present invention.

FIG. 6 shows a plan view of a 410 gauge barrel 24 modified in accordance with the present invention. As can be seen in FIG. 5, the length of the oblong section 48 may vary, but for aesthetic purposes it is shown tapering down to the regular cylindrical barrel portion 46 at the front end of the fore-end.

FIGS. 7 through 11 show various embodiments of the oblong sections 48 of the barrel which form the subject matter of the present invention. In each of the embodiments, the maximum horizontal dimension, or width, is shown as *a* which happens to be the width of the corresponding section of the standard (in this case 12 gauge) barrel. Also, in each of the embodiments, the inside diameter or the bore 50 of the barrel is the same.

Figure 7:
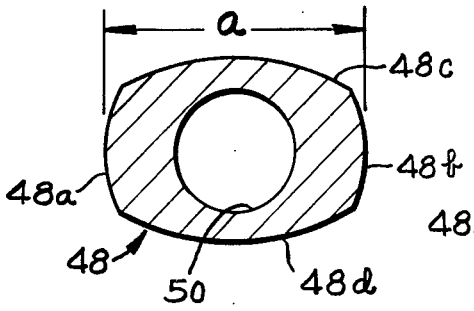
FIG. 7 is a preferred embodiment of a cross-sectional, end view through Line 7—7 of FIG. 6.

FIG. 7 shows the preferred embodiment of an oblong section 48 in which the exterior side surfaces 48*a* and 48*b* and upper and lower surfaces 48*c* and 48*d* are radiused. It can be seen that the upper and lower surfaces have a larger radii of curvature than the side surfaces. This embodiment is preferred because it is both pleasing in appearance and relatively easy to manufacture.

Figure 8:
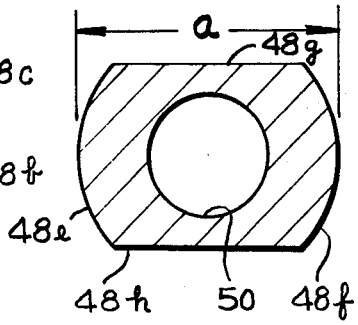
FIG. 8 is an alternate embodiment of a cross-sectional, end view through Line 7—7 of FIG. 6.

FIG. 8 shows an alternative embodiment in which the side surfaces 48*e* and 48*f* are radiused and the upper and lower surfaces 48*g* and 48*h* are substantially flat or horizontal.

Figure 9:
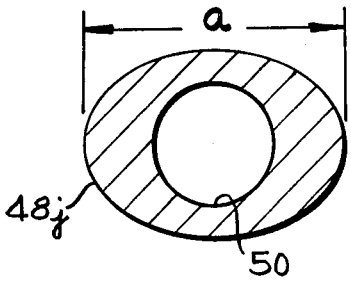
FIG. 9 is another alternate embodiment of a cross-sectional, end view through Line 7—7 of FIG. 6.

FIG. 9 shows another alternative embodiment in which the exterior surface 48*j* of the barrel is in an elliptical form. Obviously, the form need not be a true ellipse.

Figure 10:
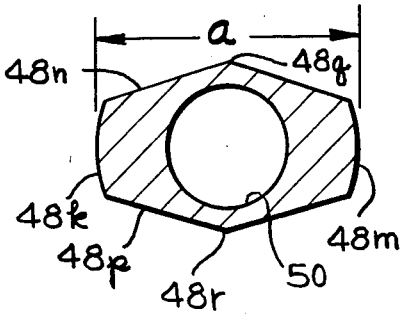
FIG. 10 is still another alternate embodiment of a cross-sectional, end view through Line 7—7 of FIG. 6.

FIG. 10 shows still another alternative embodiment in which the side surfaces 48*k* and 48*m* are radiused and the upper and lower surfaces 48*n* and 48*p* extend outwardly from the ends of the side surfaces to meet at points 48*g* and 48*r;* the vertical distance between points 48*q* and 48*r* being the maximum vertical dimension of this barrel embodiment.

Figure 11:
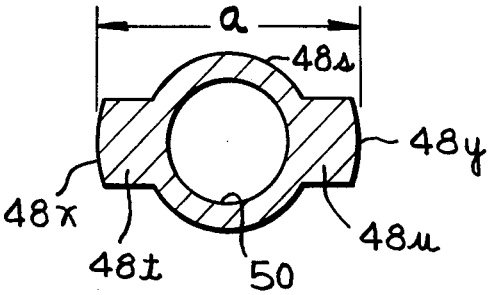
FIG. 11 is a further alternate embodiment of a cross-sectional, end view through Line 7—7 of FIG. 6.

FIG. 11 shows another alternative embodiment in which the central portion 48*s* is circular and wherein lugs 48*t* and 48*u* extend outwardly from the barrel to the proper dimension. The side surfaces 48*x* and 48*y* are radiused as in the other embodiments.

What is claimed is:

1. In a firearm having a receiver in which a plurality of gun barrels of various bore diameters can be interchangeably mounted, a U-shaped fore-end of suitable dimensions to permit interchangeability of said barrels of various bore diameters including a standard barrel, said standard barrel being defined as the barrel with the maximum bore size which it is desired to mount interchangeably in said receiver and fore-end, said fore-end having a standard open-end portion which fits closely to the outside diameter of a section of the standard barrel, the improvement comprising a gun barrel having a smaller diameter bore than said standard barrel, the section of said barrel with the smaller diameter bore which is adjacent to said fore-end being of an oblong cross section which has its maximum horizontal dimension greater than the maximum vertical dimension so as to fit closely to the fore-end.

2. In a firearm as recited in claim 1 wherein said barrel of oblong cross section has the same width as the outside diameter of the corresponding section of the standard gun barrel which is positioned adjacent to said fore-end so that the smaller bore, oblong gun barrel fits in the open-end portion of the fore-end with the same precision as said standard barrel.

3. In a firearm as recited in claim 2 wherein said smaller bore, oblong gun barrel is so configured only for the length of the fore-end whereupon said smaller bore barrel tapers down to a circular cross section forwardly of the front end of said fore-end.

4. In a firearm as recited in claim 1 wherein said oblong barrel has its maximum horizontal dimension substantially the same as the corresponding section of the standard gun barrel positioned adjacent to said fore-end and its maximum vertical dimension less than said maximum horizontal dimension.

5. In a firearm as recited in claim 4 in which said oblong barrel has radiused side exterior surfaces as well as radiused upper and lower surfaces, said upper and lower surfaces having larger radii than said side surfaces.

6. In a firearm as recited in claim 4 in which said oblong barrel has radiused side exterior surfaces and said upper and lower surfaces are substantially horizontal.

7. In a firearm as recited in claim 4 in which said oblong barrel has radiused side exterior surfaces and flat, inclined, upper and lower surfaces which extend outwardly from said radiused side surfaces to meet at points which are on the vertical axis of the bore of said oblong barrel, the distance between said points constituting the maximum vertical dimension of said oblong barrel.

8. In a firearm as recited in claim 4 in which the exterior surface of said oblong barrel is elliptical with the major axis having a dimension substantially the same as the corresponding section of the standard gun barrel positioned adjacent to said fore-end.

9. In a firearm as recited in claim 4 in which said oblong barrel has an exterior surfaces having a central, substantially circular portion, a lug extending outwardly from each side of said central portion to the desired horizontal dimension, said lugs being radiused on their sides so as to fit closely to the fore-end.

10. A barrel assembly which can be interchangeably mounted to a receiver of a firearm and a U-shaped fore-end having an open end of a standard width, said barrel assembly comprising a barrel and means on the rear end of said barrel for supporting and detachably connecting said barrel to said receiver, said barrel comprising a centrally-positioned circular bore and a portion of the barrel, at least as long as said fore-end, having an oblong, exterior cross section in which the maximum horizontal dimension is greater than the maximum vertical dimension, said maximum horizontal dimension of said oblong barrel portion being essentially equal to the standard width of the open end of said U-shaped fore-end so as to provide a close fit of said oblong barrel portion with said fore-end.

11. A barrel assembly as recited in claim 10 in which said oblong barrel portion has radiused side exterior surfaces and radiused upper and lower exterior surfaces, said upper and lower surfaces having greater radii than said side surfaces.

12. A barrel assembly as recited in claim 10 in which said oblong barrel portion has radiused side exterior surfaces and said upper and lower surfaces are substantially horizontal.

13. A barrel assembly as recited in claim 10 in which said oblong barrel portion has radiused side exterior surfaces and flat, inclined, upper and lower surfaces extending outwardly from said radiused side surfaces to meet at points which are on the vertical axis of the bore of said barrel, the distance between said points constituting the maximum vertical dimension of said barrel.

14. A barrel assembly which can be interchangeably mounted to a receiver of a firearm, said barrel assembly comprising a barrel and means on the rear end of said barrel for supporting and detachably connecting said barrel to said receiver, said barrel comprising a centrally-positioned circular bore and at least a portion of the barrel thereof having an oblong, exterior cross section in which the maximum horizontal dimension is greater than the maximum vertical dimension, the exterior surface of said oblong barrel portion being elliptical.

15. A barrel assembly which can be interchangeably mounted to a receiver of a firearm, said barrel assembly comprising a barrel and means on the rear end of said barrel for supporting and detachably connecting said barrel to said receiver, said barrel comprising a centrally-positioned circular bore and at least a portion of the barrel thereof having an oblong, exterior cross section in which the maximum horizontal dimension is greater than the maximum vertical dimension, said oblong barrel portion having an exterior surface with a central, substantially circular portion and a lug extending outwardly from each side of said central portion to the desired horizontal dimension, said lugs being radiused on their sides.

16. A method of utilizing a common firearm receiver and a common fore-end to permit interchangeability of a pluralilty of gun barrels of various bore diameters, said method comprising:

1. providing a U-shaped fore-end which has its upper free edges dimensioned so that they will be in close fitting relationship with the outside diameter of the barrel having the largest bore diameter which will be used with the common receiver and common fore-end; and
2. providing a section of each barrel having a smaller bore diameter than said barrel having the largest bore diameter, which is to be interchangeable in the common fore-end, with an oblong portion at least for the length of the barrel which is to be covered by the common fore-end, said oblong portion having its horizontal dimension of the same size as the outside diameter of the corresponding portion of said largest bore barrel so that each smaller-bore diameter barrel will have a close fitting relationship with the upper free edges of said common fore-end when assembled in said common receiver and common fore-end.

* * * * *

UNITED STATES PATENT AND TRADEMARK OFFICE

CERTIFICATE OF CORRECTION

PATENT NO. : 3,979,851

DATED : SEPTEMBER 14, 1976

INVENTOR(S) : KENNETH W. SOUCY

It is certified that error appears in the above-identified patent and that said Letters Patent are hereby corrected as shown below:

Col. 1, Line 25, "fun" should read as "gun"; Col. 1, Line 43, "use" should read as "used"; Col. 1, Line 56, "complet" should read as "complete". Col. 3, Line 1, "team" should read as "term"; Col. 3, Line 4, "that" should read as "than". Col. 4, Line 31, "48g" should read as "48q". Col. 5, Line 30, "surfaces" should read as "surface".

Signed and Sealed this

Fifteenth Day of February 1977

[SEAL]

*Attest:*

RUTH C. MASON
*Attesting Officer*

C. MARSHALL DANN
*Commissioner of Patents and Trademarks*